US007097501B2

(12) United States Patent
Shah

(10) Patent No.: US 7,097,501 B2
(45) Date of Patent: Aug. 29, 2006

(54) MICRO COATED ELECTRICAL FEEDTHRU

(75) Inventor: Jagdish Shah, Wallingford, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/722,091

(22) Filed: Nov. 25, 2003

(65) Prior Publication Data

US 2005/0112942 A1 May 26, 2005

(51) Int. Cl.
*H01R 13/40* (2006.01)

(52) U.S. Cl. ..... 439/589; 439/935; 428/408; 174/50.5; 174/151; 257/698

(58) Field of Classification Search ..... 439/589, 439/587, 935; 428/408; 427/96, 97, 249.7, 427/902; 174/110 R, 71 R, 72 R, 72 C, 50.5, 174/65 R, 151–153, 102 SC; 257/698, 699, 257/708, 709

See application file for complete search history.

(56) References Cited

U.S. PATENT DOCUMENTS 3,998,515 A * 12/1976 Panek ..... 439/198
4,174,145 A * 11/1979 Oeschger et al. ..... 439/589
4,252,394 A * 2/1981 Miller ..... 439/566
4,519,662 A * 5/1985 Riley et al. ..... 439/271
4,878,850 A * 11/1989 Letemps et al. ..... 439/83
5,565,262 A * 10/1996 Azzaro et al. ..... 428/210
5,595,514 A * 1/1997 Romano et al. ..... 439/886
5,691,010 A * 11/1997 Kuramoto et al. ..... 427/577
5,698,272 A * 12/1997 Smentkowski et al. ..... 427/551
5,994,975 A * 11/1999 Allen et al. ..... 333/26
6,023,025 A * 2/2000 Nakahigashi et al. ... 174/110 R
6,090,456 A * 7/2000 Wu et al. ..... 427/577
6,362,424 B1 * 3/2002 Honkomp et al. ..... 174/50.52
6,375,826 B1 * 4/2002 Wang et al. ..... 205/684
6,452,102 B1 * 9/2002 DeForest et al. ..... 174/75 C
6,509,525 B1 * 1/2003 Honkomp et al. ..... 174/50.52
6,517,405 B1 * 2/2003 Cheng et al. ..... 445/5
6,572,935 B1 * 6/2003 He et al. ..... 427/577
6,632,104 B1 * 10/2003 Quadir ..... 439/587
6,660,342 B1 * 12/2003 Miyanaga et al. ..... 427/571
6,716,063 B1 * 4/2004 Bryant et al. ..... 439/589
6,739,946 B1 * 5/2004 Chao et al. ..... 451/7
6,793,849 B1 * 9/2004 Gruen et al. ..... 252/502
6,840,310 B1 * 1/2005 Tonosaki et al. ..... 165/104.21
6,903,268 B1 * 6/2005 Marshall et al. ..... 174/50.59
2005/0024837 A1 * 2/2005 Youker et al. ..... 361/782

FOREIGN PATENT DOCUMENTS

DE 2635613 A1 9/1978

* cited by examiner

*Primary Examiner*—Gary F. Paumen
(74) *Attorney, Agent, or Firm*—Jody Lynn DeStefanis; William L. Wang; David Larson

(57) ABSTRACT

A method and apparatus for electrically interfacing between two or more distinct environments. The method and apparatus are directed to an electrical feedthru with one or more electrical transmission lines coated with one or more thin dielectric layers of material to insulate the transmission lines from a feedthru body. The dielectric layers may include a diamond-like carbon coating, which electrically insulates, but also thermally conducts. The use of thin dielectric layers facilitates smaller, more efficient electrical feedthrus. Therefore, the electrical feedthru may be used, for example, with MEMS devices. The electrical feedthru is not limited to any particular geometry, it may be adapted to fit between any two environments.

38 Claims, 3 Drawing Sheets

MICRO COATED ELECTRICAL FEEDTHRU

FIELD OF THE INVENTION

The present invention relates generally to methods and apparatus for transmitting electrical signals, power, or both. More particularly, the present invention relates to transmitting electrical signals, power, or both across two or more distinct environments.

BACKGROUND OF THE INVENTION

A variety of standard methods and devices currently exist for passing electrical signals and current across distinct environments. Such devices are commonly referred to as electrical feedthrus or bulkheads. The intent of electrical feedthrus is to facilitate passage of the electrical signals, current, or both across the distinct environments without breaching the integrity of any boundary between the two distinct environments. One variety of electrical feedthrus includes epoxy encapsulated transmission lines. The transmission lines are usually centered within the epoxy capsule, with the lines running parallel to the epoxy capsule. The epoxy capsule insulates the transmission lines at a boundary between two distinct environments. Another variety of electrical feedthrus includes constructing a boundary body between two distinct environments with non-conductive materials and inserting the transmission lines through the boundary body. The boundary body between the two distinct environments is then sealed by standard sealing techniques, such as the use of an O-ring. Glass and ceramic capsules or boundary bodies are also commonly used.

However, these standard electrical feedthrus have a number of drawbacks. The primary problem associated with standard electrical feedthrus is the use of dissimilar materials for construction of the feedthru. For example, an electrical feedthru (2) shown in FIG. 1 requires a thick pre-formed ceramic or glass insulator capsule (4) set in a body (6) to electrically isolate a pin (8) inserted through the insulator capsule (4) from the body (6). The thick insulator capsule (4) is typically made of glass or ceramic, and the pins (8) and body (6) are metallic. The coefficients of thermal expansion of metals and ceramics are generally quite different. Therefore, to maintain the integrity of the seal between the ceramic and the metal, typical electrical feedthrus are limited to a relatively narrow range of temperatures and pressure fluctuations. For example, if the body (6) is steel and the insulator capsule (4) is ceramic, the body (6) would expand more than twice as much as the insulator capsule (4) when subjected to an increase in temperature. The larger the increase in temperature, the larger the difference between the expansion of the body (6) and the insulator capsule (4). This difference in expansion causes high stresses at an interface (9) between the body (6) and the insulator capsule (4). High stresses at the interface (9) result in feedthrus that are prone to failure, and thus limit the performance of the feedthrough.

Another problem associated with electrical feedthrus is the size. Standard electrical feedthrus are often much too large for many applications, particularly for micro-electro-mechanical-systems (MEMS). The electrical feedthru (2) shown in FIG. 1 is considered a very small one, possibly the smallest currently available ceramic feedthru useful in high pressure, high temperature applications. However, the electrical feedthru (2) shown in FIG. 1 requires a pre-formed ceramic or epoxy insulator capsule (4) that has a wall thickness of at least 750 μm. Further, as the number of transmission lines needed increases, the size of the electrical feedhthrus or bulkheads becomes even larger. Referring again to FIG. 1, only a single pin (8) can be located within the thick insulator capsule (4) while maintaining electrical isolation, and the diameter of the ceramic insulator (4) is at least 2 mm. Therefore, according the spacing shown, it takes at least a diameter of 8.0 mm to arrange the six transmission lines or pins (8). However, in actual practice the electrical feedhtru is at least 9.0 mm in diameter to provide support for the multiple ceramic insulator capsules (4). There are many instances, including applications to MEMS devices, where a much larger density of transmissions lines and a much smaller electrical feedthru would be desirable.

Yet another disadvantage of typical electrical feedthrus is the inability of ceramic, glass, and epoxy material to conduct heat. Poor heat conduction means limited ability to dissipate heat. Therefore, typical electrical feedthrus such as the feedthru (2) shown in FIG. 1 are not capable of efficiently dissipating heat through the body (6). Accordingly, any heat-generating devices connected to the transmission lines (8) must be cooled without the aid of conducting heat through the body (6).

SUMMARY OF THE INVENTION

The present invention addresses the above-described deficiencies and others. Specifically, the present invention provides an electrical feedthru that can be made much smaller than conventional feedthrus. One feedthru according to the present invention includes an electrically conductive transmission line, a coating of dielectric material disposed over the electrically conductive transmission line, and a housing attached about at least a portion of the electrically conductive transmission line. The coating of dielectric material is a micro-coating that may include one or more layers of diamond-like carbon coating or other materials. According to some embodiments, the micro-coating is only 500 μm thick or less, according to others, the micro-coating is only 100 μm or less, and according to still others the micro-coating is only 10 μm or less. According to some embodiments, the electrical feedthru is part of or attached to a MEMS package.

Some embodiments of the electrical feedthru include a secondary coating between the housing and the coating of dielectric material. The secondary coating may be an adhesive or other material.

Another embodiment of the present invention provides an electrical feedthru with a transmission line density of at least 0.4 pins per $mm^2$. The density may also be at least 0.8 transmission lines per mm according to other embodiments. A high pin density facilitates more transmission lines in smaller packages.

Another embodiment of the invention provides a multi-pin feedthru including a plurality of conductive pins extending through a single body, each of the plurality of conducting pins spaced from one another, and a least one thin film layer of dielectric material disposed over each of the plurality of conducting pins. The thin film layer provides electrical insulation between the pins and the body. The thin film layer may include a diamond-like carbon coating or other materials capable of providing electrical insulation, even at very small thicknesses, such as 100 μm or less.

Another embodiment of the invention provides a MEMS package including an electrical feedthru separating distinct environments. The electrical feedthru portion of the MEMS package includes a housing, an electrical pathway passing through the housing, and an electrical isolator less than about 500 μm thick disposed between the housing and the electrical pathway. The electrical isolator may be less then 100 μm thick, and may include a diamond-like carbon coating. The electrical isolator may sometimes comprise one or more layers ranging between approximately 0.2 and 10 μm in thickness.

Another aspect of the invention provides a method of making an electrical feedthru. The method includes coating a conductive pin or other electrical transmission line with a layer of highly dielectric material and attaching the conductive pin to a housing. The method may include adding multiple layers of highly dielectric material to the pin, each layer comprising a thickness of about 10 μm less. According to some aspects, the method includes applying a dielectric adhesive to the housing, the conductive pin, or both the housing and the conductive pin to attach the conductive pin to the housing. The method may also include metalizing an outer surface of the conductive pin over the micro-layer of highly dielectric material and brazing the conductive pin to the housing.

According to some aspects of the invention, the housing is heated to a temperature above ambient, the conductive pin is inserted into a hole in the housing, and the body is cooled to compress the conductive pin within the housing.

Another aspect of the invention provides a method of controlling capacitance of an electrical feedthru. The method includes coating a conductive pin with one or more micro-layers of dielectric material. The method may include varying the thickness of one or more of the layers, which may be diamond-like-coatings or diamond thin films. The method may further include adding a layer of adhesive over an outermost layer of the one or more layers of highly dielectric material.

Additional advantages and novel features of the invention are set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Figure 1:
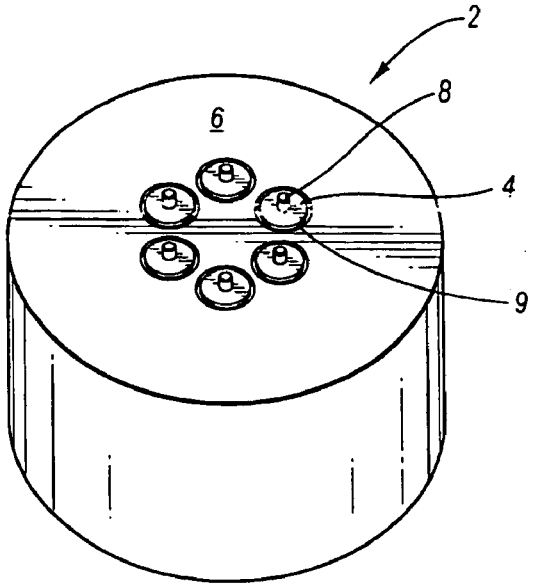
Fig. 1 (Prior Art)
FIG. 1 is a top view of an electrical feedthru according to the prior art.

Throughout the drawings, identical reference numbers and descriptions indicate similar, but not necessarily identical elements. While the invention is susceptible to various modifications and alternative forms, specific embodiments have been shown by way of example in the drawings and are described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE PREFERRED EMBODIMENTS

Illustrative embodiments and aspects of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

The present invention contemplates methods and apparatus for transmitting electrical signals, power transmission, or both between two or more distinct environments. As mentioned in the background, devices used for electrical transmission across two or more distinct environments are commonly referred to as "electrical feedthrus" or "electrical bulkheads." The principles described herein facilitate electrical feedthrus that can be made much smaller than conventional feedthrus, although electrical feedthrus of the conventional size may also be made according the same principles. The construction of smaller electrical feedthrus facilitates use in smaller packages, for example, in a MEMS package.

Further, according to principles of the present invention, the capacitance of electrical feedthrus can be controlled. Controlling feedthru capacitance is particularly useful, for example, when the feedthru is used with certain high-frequency applications. Some embodiments of the electrical feedthru according to principles described herein may also facilitate heat transfer, which is not possible using typical feedthrus.

As used throughout the specification and claims the term "micro" means very small, usually on the order of $10^{-6}$. However, when used as an indication of a dimension such as thickness, "micro" may include any dimension that is less than or equal to approximately 500 μm. The term "film" is used broadly to mean a thin covering or coating that is not pre-formed. A "film" is typically thinner than the object it covers. "Coating" means one or more layers of material covering and coated onto something else, particularly wherein the one or more layers are less than or equal to approximately 500 μm in thickness. A "dielectric" material means a material that tends not to conduct electricity. A "highly dielectric" material is a material that has an electrical resistivity of up to $10^{12}$ ohm-cm, usually ranging between $10^9$ and $10^{12}$ ohm-cm. The term "pin" is used broadly to mean any electrically conductive transmission path. The words "including" and "having," as used in the specification, including the claims, have the same meaning as the word "comprising."

Figures 2A, 2B, 2C, 2D:
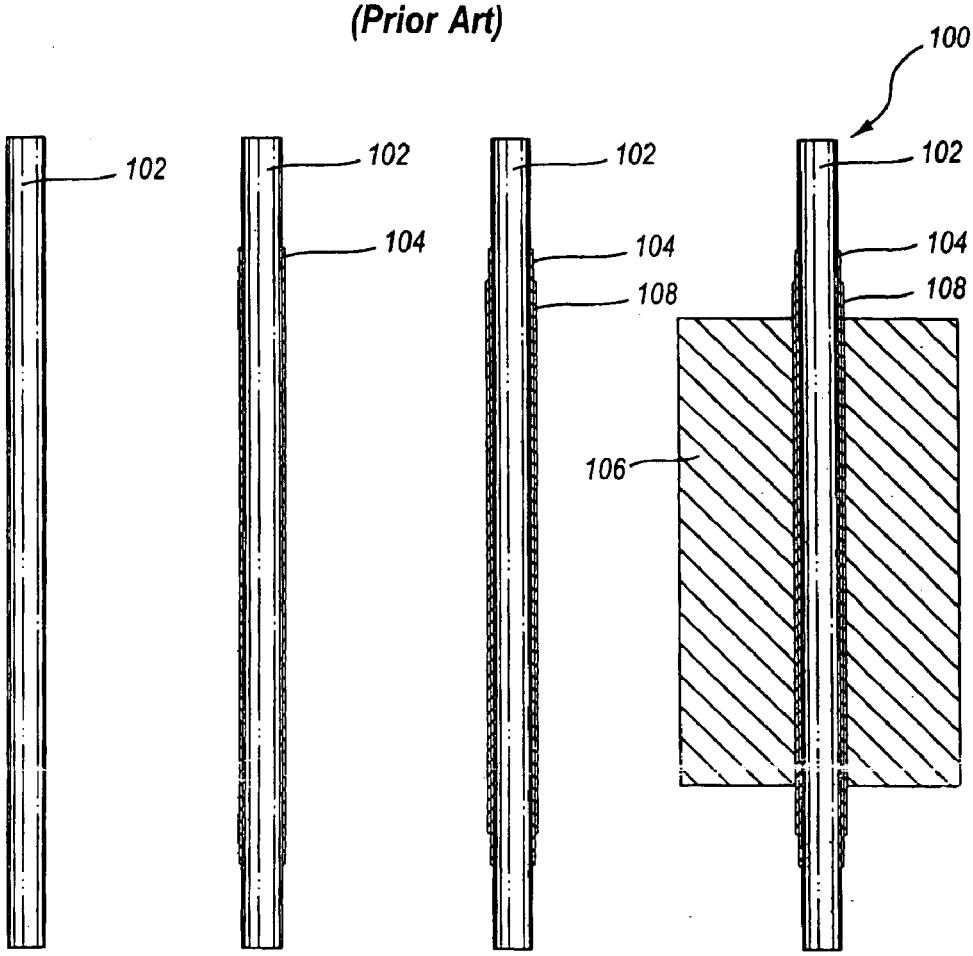
FIG. 2A is a side view of an electrical feedthru transmission line according to one embodiment of the present invention.
FIG. 2B is a side view of the electrical feedthru transmission line of FIG. 2A, with an insulating coating covering a portion of the transmission line according to one embodiment of the present invention.
FIG. 2C is a side view of the electrical feedthru transmission line of FIG. 2B, with an optional secondary coating covering a portion of the insulating coating according to one embodiment of the present invention.
FIG. 2D is a cross-sectional side view of the electrical feedthru of FIG. 2C, with the transmission line disposed in and attached to an outer body or housing to form an electrical feedthru according to one embodiment of the present invention.

Turning now to the figures, and in particular to FIG. 2D, an electrical feedthru (100) according principles of the present invention is shown. The electrical feedthru (100) includes an electrically conductive transmission line, for example a conductive pin (102). The conductive pin (102) is preferably made of metal, for example copper, stainless steel, or other metal. At least a portion of the conductive pin (102) is covered with a dielectric coating. According to the embodiment of FIG. 2D, the coating of dielectric material is a micro-coating (104) disposed over the conductive pin (102). The micro-coating (104) comprises one or more layers or thin films of dielectric material.

According to some embodiments, the micro-coating (104) is no more than approximately 500 μm thick. More preferably, the micro-coating (104) is no more than approximately 100 μm thick, and may include one or more layers, with each layer approximately 0.2 to 10 μm thick. For example, the micro-coating (104) may include a first layer less than 1.0 μm thick, and at least one additional layer approximately 2–5 μm thick.

The micro-coating (104) is preferably highly dielectric and may also be thermally conductive. For example, the micro-coating (104) may comprise carbon, such as a diamond-like carbon coating (DLC), or a diamond-like thin film. DLCs are generally very good thermal conductors and have an electrical resistivity ranging between approximately $10^9$ and $10^{12}$ ohm-cm. Therefore, the micro-coating (104) may have a breakdown voltage of at least 50 V per μm of coating thickness, preferably on the order of about 100V per μm of coating thickness. However, the micro-coating (104) is not limited to DLCs and diamond thin films. Other coatings, including, but not limited to, controlled atmosphere plasma sprayed (CAPS) ceramics may also be used. If a DLC is used, the DLC may include silicon or other materials to enhance adhesion of the micro-coating (104) to the conductive pin (102).

The conductive pin (102) extends through an outer body or housing (106). The housing (106) is preferably comprised of metal, but this is not necessarily so. Other materials, including, but not limited to, plastics, ceramics, glass, and composites may also be used. The conductive pin (102) is attached to and sealed within the housing (106) to prevent any fluid communication therethrough. Therefore, electrical power and/or signals may pass through the housing (106), but fluids may not. The housing (106) may include a variety of shapes, such as the cylindrical shape shown in FIG. 2D. However, any convenient shape can be used to facilitate insertion of the electrical feedthru (100) between any two distinct environments.

The housing (106) may have a much smaller diameter than available previously. For example, the housing (106) may have a diameter of approximately 0.5 mm or less, the limiting factor being enough material to support the conductive pin (102) and micro-coating (104). However, larger diameter housings may be used with micro-coatings as described herein as well. The present invention effectively reduces the thickness of the insulator required by previous feedthrus. The micro-coating (104) can be much thinner than the minimum thickness of at least 750 μm associated with even the smallest of feedthrus as shown in FIG. 1.

To facilitate hermetic attachment between the housing (106) and the conductive pin (102) with the micro-coating (104), the electrical feedthru (100) may also include a secondary coating between the micro-coating (104) and the housing. According to FIG. 2D, an optional dielectric adhesive layer (108) is disposed over the micro-coating (104). According to FIG. 2D, the dielectric adhesive layer (108) extends along the conductive pin (102) for at least the length of the housing (106). Nevertheless, according to some embodiments the dielectric adhesive layer (108) is applied only along a portion of the length of the conductive pin (102) through the housing (106), and according to other embodiments the dielectric adhesive layer (108) is omitted altogether. If used, the dielectric adhesive layer (108) may comprise Araldite GY 6010, Amine Hardener HY 5200, or other products. In addition, according to some embodiments, the secondary coating is not a dielectric adhesive layer but instead comprises a metal layer brazed between the micro-coating (104) and the housing (106).

FIGS. 2A–2D illustrate a method of making the electrical feedthru (100). The method includes coating the conductive pin (102) with a layer of highly dielectric material and attaching the conductive pin (102) to the housing (106). The layer of highly dielectric material may be the micro-coating (104) shown in FIG. 2B. As mentioned above, the micro-coating (104) may comprise a DLC, a diamond thin film, a ceramic, or other material. DLCs can be deposited on the conductive pin (102) by standard industrial procedures in thicknesses up to about 10 μm per layer. Diamond thin films can be applied to the conductive pin (102) using microwave plasma chemical vapor deposition (MPCVD). In addition, thin layers of ceramic may be applied by controlled atmosphere plasma spraying (CAPS). Other methods of coating the conductive pin (102) with the micro-coating (104) may also be used.

Multiple layers may be applied to the conductive pin (102) to create the micro-coating (104). For example, as mentioned above, a first DLC layer may be applied at a thickness of between 0.2 and 1.0 μm. Silicon may be added to the DLC to enhance adhesion of the DLC to the conductive pin (102). A second DLC layer may then be added that ranges between 2 and 5 μm thick, and may be optimized for adhesion to the first layer and for hardness. However, any number of layers of any thickness may be used. To increase the quantity of dielectric material between the conductive pin (102) and the housing (106), it may also be desirable to apply dielectric material, such as micro-coating (104), to the portions of the housing placed in contact with the conductive pin. Dielectric material, such as micro-coating (104), may also be applied to the external surfaces of housing (106), to form an electrically resistive barrier between the housing and the external environment for instance.

Micro-coating (104) hardness can be varied to achieve optimized results so that the process of attachment of the conductive pin (102) to the housing (106) preserves the integrity of the micro-coating (104). For example, higher hardness may result in a deformation of the conductive pin (102) material and/or the housing (106) when subjected to a contact pressure across the micro-coating (104). Contact pressures are common during an electrical feedthru assembly sequence according to the present invention. On the other hand, a lower hardness for the micro-coating (104) may facilitate a better hermetic seal between the conductive pin (102) and the housing (106). Therefore, the thickness of the layers comprising the micro-coating (104) may be varied to achieve a desired hardness. As an example, the conductive pin (102) coated with a total thickness of 2.8 μm of DLC has a measured hardness of approximately 15 GPa, while a similar pin having a total DLC coating thickness of 4.8 μm has a measured hardness of approximately 11 GPa.

Because the micro-coating (104) is so thin, it conforms to the surface roughness of the conductive pin (102), which can be detrimental to the integrity of the micro-coating (104) during attachment to the housing (106). Therefore, according to some embodiments the conductive pin (102) is polished to minimize surface roughness prior to application of the micro-coating (104). For example, the conductive pin (102) may be electro-polished according to some embodiments to provide a smooth surface finish. Those of skill in the art having the benefit of this disclosure will recognize, however, that other smoothing techniques may also be employed to achieve an acceptable surface finish. Preferably the surface roughness of the conductive pin (102) is less than the anticipated thickness of the micro-coating (104).

The method of making the electrical feedthru (100) may include applying a dielectric adhesive to the housing (106), the conductive pin (102), or both the housing (106) and the conductive pin (102) to attach and seal the conductive pin (102) within the housing (106). Alternatively, the outer surface of the conductive pin (102), which is coated with the micro-coating (104), may be metalized. Following metallization, the conductive pin (102) can be brazed to the housing (106) according to some methods. The brazing method may be particularly helpful in promoting thermal conduction through the electrical feedthru (100).

Figure 3:
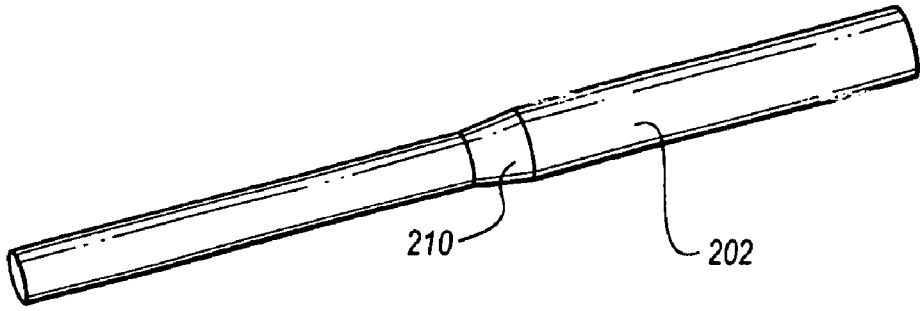
FIG. 3 is a perspective view of a conductive pin according to another embodiment of the present invention.

Other electrical feedthru embodiments may also be made according to principles of the present invention. For example, with reference to FIGS. 3–4, a conductive pin (202) may include a first tapered surface (210) to facilitate mechanical or compressional attachment to an alternative housing (206). The conductive pin (202) includes a coating such as the micro-coating (104) shown more clearly in FIG. 2B, and may also include the secondary coating (108) shown more clearly in FIG. 2C.

The housing (206) includes a second tapered surface (212) shaped to mate with the first tapered surface (210) of the conductive pin (202). Therefore, according to some embodiments, the conductive pin (202) is attached to the housing (206) by inserting the conductive pin (202) into the housing (206) and wedging the first and second tapered surfaces (210, 212) into a mechanical seal.

However, according to some embodiments, the dimensions of the first and second mating tapered surfaces (210, 212) interfere, such that the tapered surfaces will not normally directly interface with one another at ambient conditions. Therefore, the conductive pin (202) may be attached to the housing (206) by heating the housing (206) to a temperature above ambient, inserting the conductive pin (202) into the housing, and cooling the body to compress the conductive pin (202) within the housing (206) while rigidly holding the conductive pin (202) against the housing (206). As the housing (206) cools, the first and second tapered surfaces are subjected to a sealing contact pressure.

In addition, the conductive pin (202) and the housing (206) may be made of materials with similar or identical coefficients of thermal expansion. Therefore, because the insulating coating (104, FIG. 2B) is thin (and therefore its effects are marginal), the electrical feedthru (200) of the present invention may be used over a wider range of temperature and pressure variations while maintaining the integrity of the seal between the conductive pin (202) and the housing (206).

Figure 4:
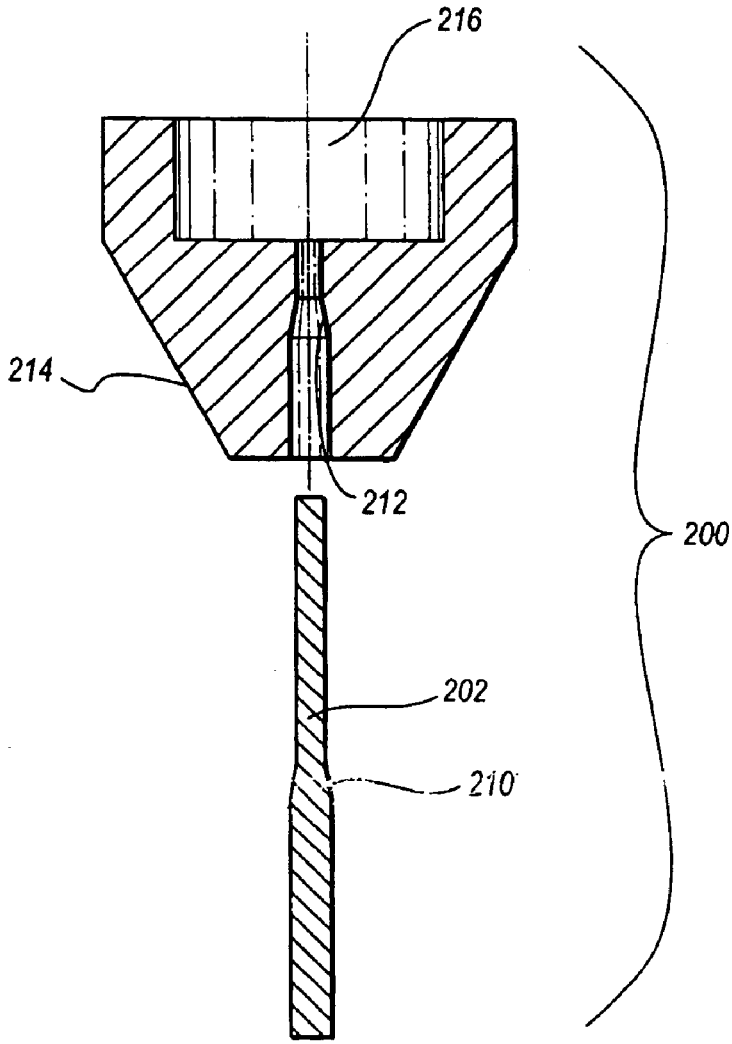
FIG. 4 is a cross-sectional view of a feedthru body in relation to the conductive pin of FIG. 3 according to another embodiment of the present invention.

As shown in FIG. 4, the housing (206) may include an external taper (214) and/or any other shape necessary for insertion of the electrical feedthru (200) between any two distinct environments. The external taper (214) may be useful, for example, to swage-lock the electrical feedthru (200) between two environments. The housing (206) may also include a recess (216) used to house various mechanical or electrical components that may be used, for example, to connect the conductive pin (202) to another electrical pathway.

Figure 5:
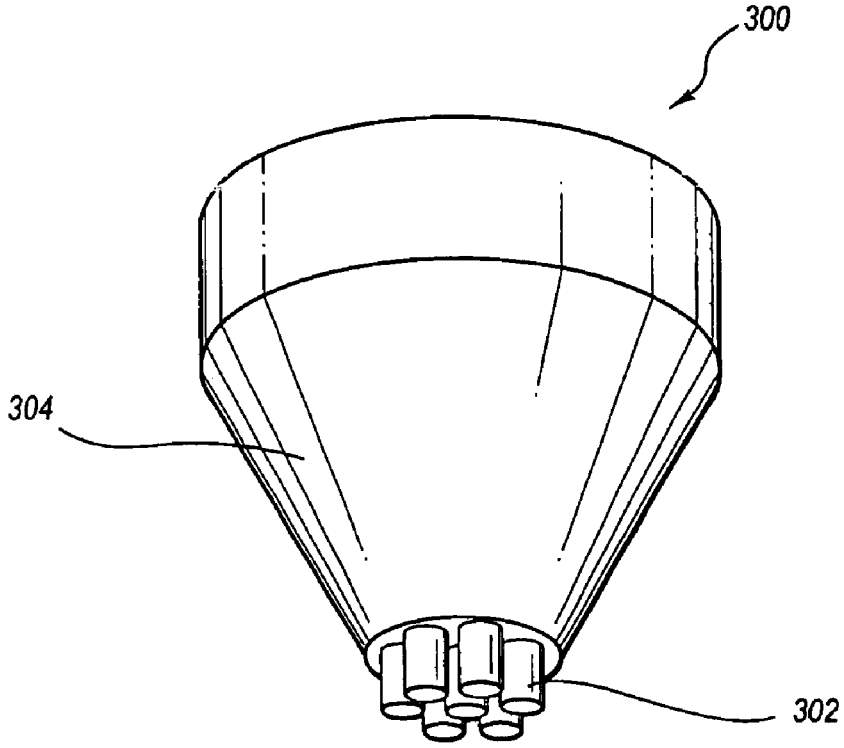
FIG. 5 is a perspective view of an electrical feedthru according to another embodiment of the present invention.

As discussed throughout this specification, electrical feedthrus according to principles of the present invention include thin coatings to electrically isolate the transmission lines as opposed to the typical large, pre-formed ceramic, glass, or plastic inserts. The use of thin coatings increases the number of isolated electrical pathways available within a given geometry. Accordingly, a plurality of conductive pins may extend through one body, with each of the conductive pins being spaced from one another and coated with at least one thin film layer of dielectric material. For example, referring to FIG. 5, an electrical feedthru (300) may include seven or more conductive pins (302) protruding through a single housing (304). According to the embodiment shown, the seven conductive pins (302) are all substantially parallel to one another and contained within a circle having a diameter of approximately 3.3 mm. Therefore, for the multi-pin configuration shown in FIG. 5, the conductive pin (302) density is approximately 0.817 pins per $mm^2$. On the other hand, the highest pin density previously available (calculated from the electrical feedthru of FIG. 1 having six pins within a 9 mm diameter) for a multi-pin configuration is approximately 0.09 pins per $mm^2$.

Further, for a single pin configuration, the maximum pin density previously available for an electrical feedthru is 0.32 pins per $mm^2$ (1 pin within a diameter of approximately 2 mm as shown in FIG. 1). The present invention provides for even higher pin densities for single-pin configurations. For example, for the electrical feedthru (100) shown in FIG. 2D, the pin density is approximately 5.1 lines per $mm^2$ (one pin contained within the housing 106 having a diameter of approximately 0.5 mm). Therefore, according to some embodiments of the present invention, the electrical feedthru (300) has a pin density greater than 0.32 pins per $mm^2$. More preferably, the electrical feedthru (300) has a pin density of at least 0.4 pins per $mm^2$. And as mentioned above, some embodiments of the electrical feedthru (300) have a pin density of at least 0.8 pins per $mm^2$ or at least 5.0 lines per $mm^2$. It will be understood by those of skill in the art having the benefit of this disclosure, however, that the seven conductive pins (302) are not necessarily parallel to one another, and that any number of conductive pins (302) may be inserted through a given housing.

The use of thin coatings for electrical feedthrus provides advantages in addition to smaller size as well. For example, because coatings are thin as compared to typical electrical isolators, detrimental effects resulting from different thermal expansion rates between the feedthru components is minimized. The thin coatings may be a very good thermal conductor as well, enabling the feedthru to be used as a tool of thermal management by providing a thermal path through the coating to the housing, which may act as a heat sink. DLCs and diamond thin films are exceptionally good thermal conductors, as opposed to the poor thermal conductive properties associated with ceramics. In addition, the thickness of the micro-layers and the optional use of dielectric adhesives can be varied to manipulate the capacitance of the electrical feedthrus. As mentioned above, controlling the capacitance of an electrical feedthru offers significant advantages, especially when the feedthru is used in a high-frequency circuit. The capacitance varies inversely with the thickness of the micro-coating, and directly with permittivity of the material. The permittivity of dielectric adhesive can be orders of magnitude less than that of a DLC coating. Therefore, even with a relatively thick layer of adhesive, the capacitance of the electrical feedthru can be controlled.

Figure 6:
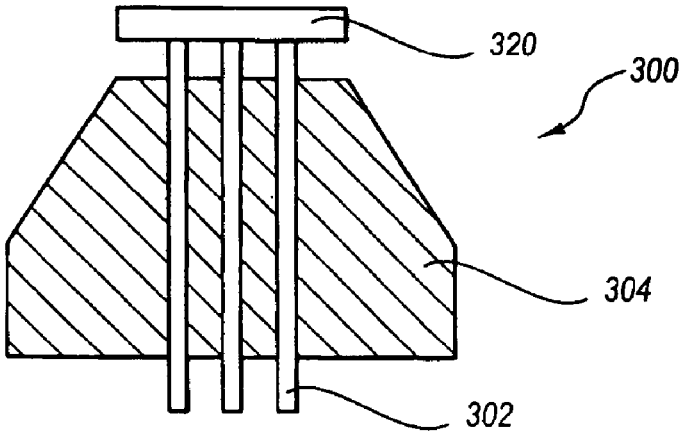
FIG. 6 is a side view of the electrical feedthru of FIG. 5 packaged in a MEMS device according to one embodiment of the present invention.

Moreover, electrical feedthrus made according to principles of the present invention may be used in very small devices, such as MEMS packages. For example, the electrical feedthru (300) may be used with a MEMS device (320) shown in FIG. 6. The MEMS device (320) shown is electrically connected to the conductive pins (302) with a conductive epoxy. However, other connection mechanisms may also be used. The high number of electrical transmission lines through the small electrical feedthru (300) allows use of electrical feedthrus in micro-settings, which has heretofore been difficult or impossible.

The preceding description has been presented only to illustrate and describe the invention and some examples of its implementation. It is not intended to be exhaustive or to limit the invention to any precise form disclosed. Many modifications and variations are possible in light of the above teaching. For example, many or all of the same advantages may be achieved by coating the inside of the electrical feedthru body in addition to or alternative to coating the outside of the conductive pin. Such modifications are contemplated by the invention and within the scope of the claims.

The preferred aspects were chosen and described in order to best explain the principles of the invention and its practical application. The preceding description is intended to enable others skilled in the art to best utilize the invention in various embodiments and aspects and with various modifications as are suited to the particular use contemplated. It is intended that the scope of the invention be defined by the following claims. '

What is claimed is:

1. An apparatus comprising:

a MEMS electrical feedthru, the MEMS electrical feedthru comprising:

an outer body;

a conductive pin extending through opposite ends of and attached to the outer body;

an electrically insulating diamond-like carbon or diamond thin film micro-coating between the conductive pin and the outer body.

2. The apparatus of claim 1, wherein the insulating coating is less than 100 μm thick.

3. The apparatus of claim 2, wherein the insulating coating is less than 5 μm thick.

4. The apparatus of claim 3, wherein the insulating coating is less than 2 μm thick.

5. An electrical feedthru apparatus comprising:

a body;

a plurality of conductive pins extending through opposite ends of and attached to the body and having diamond-like carbon coatings or diamond thin films electrically insulating each of the conductive pins from the body;

wherein the conductive pin density comprises at least 0.4 pins per $mm^2$.

6. The electrical feedthru apparatus of claim 5, wherein the conductive pin density comprises at least 0.8 pins per $mm^2$.

7. An electrical feedthru comprising:

a body;

a conductive pin; and a highly dielectric diamond-like carbon coating or diamond thin film adhered to at least a portion of the conductive pin;

wherein the conductive pin extends through opposite ends of and is attached to the body.

8. The electrical feedthru of claim 7, wherein the diamond-like carbon coating or diamond thin film comprises multiple layers.

9. The electrical feedthru of claim 8, wherein a first of the multiple layers is less than 1 μm thick, and subsequent layers range between 1 and 10 μm thick.

10. The electrical feedthru of claim 7, wherein the conductive pin and the body are attached by a radial compression fit.

11. The electrical feedthru of claim 7, further comprising a plurality of conductive pins each coated with a highly dielectric diamond-like carbon coating or diamond thin film spaced from one another and attached within the body.

12. The electrical feedthru of claim 11, wherein wherein a density of the conductive pins within the body is greater than 0.32 pins per $mm^2$.

13. The electrical feedthru of claim 12, wherein the density of the conductive pins within the body is at least 0.4 pins per $mm^2$.

14. The electrical feedthru of claim 13, wherein a density of the conductive pins within the body is at least 0.8 pins per $mm^2$.

15. An apparatus comprising:

an electrical feedthru adapted for a MEMS device, the electrical feedthru comprising:

a conducting pin;

a diamond-like carbon coating or diamond thin film adhered to the conducting pin;

a body attached around the diamond-like carbon coating or diamond thin film, the pin extending through opposite ends of the body.

16. The apparatus of claim 15, further comprising a plurality of conducting pins each coated with a diamond-like carbon coating or diamond thin film disposed in the body.

17. The apparatus of claim 15, wherein the diamond-like carbon coating or diamond thin film comprises a first layer of 0.2 to 10 μm thick.

18. A multi-pin feedthru comprising:

a plurality of conductive pins extending through opposite ends of a single body sized for use with a MEMS device, each of the plurality of conductive pins being spaced from one another; and at least one thin film layer of diamond-like carbon coating or diamond thin film dielectric material on each of the plurality of conducting pins providing electrical insulation between the pins and the body.

19. The multi-pin feedthru of claim 18, wherein each of the plurality of conductive pins is substantially parallel to the others.

20. The multi-pin feedthru of claim 18 wherein the plurality of conductive pins comprises at least six pins arranged within no more than a 4 mm diameter.

21. The multi-pin feedthru of claim 18 wherein the at least one thin film layer is between 0.2 and 10 μm thick.

22. An electrical feedthru comprising:

an electrically conductive pin;

an electrically insulative, thermally conductive diamond-like carbon coating or diamond thin film adhered to the electrically conductive pin;

wherein the electrically conductive pin is hermetically sealed to a body through which the electrically conductive pin traverses, the pin extending from opposite ends of the body.

23. The electrical feedthru of claim 22, wherein the body comprises an outer taper.

24. The electrical feedthru of claim 22, wherein the electrically insulative, thermally conductive diamond-like carbon coating or diamond thin film comprises one or more layers ranging between 0.2 and 10 μm in thickness.

25. An apparatus comprising:

a micro-electro-mechanical-system (MEMS) package;

an electrical feedthru electrically attached to the MEMS package and disposed between two distinct environments, the electrical feedthru comprising:

a housing;

a pin passing through opposite ends of and attached to the housing; and a diamond-like carbon coating or diamond thin film electrical isolator less than about 500 μm thick disposed between the housing and the pin.

26. The apparatus of claim 25, wherein the electrical isolator is less than 100 μm thick.

27. The apparatus of claim 25, wherein the electrical isolator comprises one or more layers ranging between approximately 0.2 and 10 μm in thickness.

28. A method of making an electrical feedthru comprising coating a conductive pin with a layer of highly dielectric diamond-like carbon coating or diamond thin film material and attaching the conductive pin within and extending through opposite ends of, a housing.

29. The method of claim 28, wherein the coating is about 10 μm thick or less.

30. The method of claim 28, further comprising coating the conductive pin with multiple layers of highly dielectric material.

31. The method of claim 28, further comprising applying a dielectric adhesive to the housing, the conductive pin, or both the housing and the conductive pin to attach the conductive pin to the housing.

32. The method of claim 28 wherein the attaching comprises:

metalizing an outer surface of the conductive pin over the layer of highly dielectric material; and brazing the conductive pin to the housing.

33. The method of claim 28, wherein the attaching comprises:

heating the housing to a temperature above ambient;

inserting the conductive pin in a corresponding hole in the housing; and cooling the housing to compress the conductive pin within the housing.

34. The method of claim 33, wherein the attaching further comprises providing mating tapered surfaces to the conductive pin and the housing.

35. A method of controlling capacitance of an electrical feedthru comprising coating a conductive pin with one or more micro-layers of diamond-like carbon coating or diamond thin film dielectric material and attaching said conductive pin within and extending through opposite ends of, a housing.

36. The method of claim 35, further comprising varying the thickness of the one or more micro-layers of dielectric material.

37. The method of claim 35, further comprising adding a layer of adhesive over the one or more micro-layers of dielectric material.

38. A method of making an electrical feedthru comprising coating an inner surface of a hole through a housing with a layer of highly dielectric diamond-like carbon coating or diamond thin film material and attaching a conductive pin within the hole, the pin extending from opposite ends of the housing.

* * * * *